US007266876B2

(12) United States Patent
Thompson

(10) Patent No.: US 7,266,876 B2
(45) **Date of Patent: *Sep. 11, 2007**

(54) APPARATUS AND METHOD FOR FORMING RIVET JOINTS

(75) Inventor: Edwin E. Thompson, Tigard, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/514,825

(22) Filed: Aug. 31, 2006

(65) Prior Publication Data

US 2006/0288562 A1 Dec. 28, 2006

Related U.S. Application Data

(60) Continuation of application No. 10/992,321, filed on Aug. 19, 2004, now Pat. No. 7,100,272, which is a continuation of application No. 10/196,584, filed on Jul. 15, 2002, now Pat. No. 6,796,020, which is a division of application No. 09/631,876, filed on Aug. 2, 2000, now Pat. No. 6,442,823.

(51) Int. Cl.
*B23P 11/00* (2006.01)

(52) U.S. Cl. ..... 29/509; 29/524.1; 29/525.05; 29/525.06; 29/798; 29/243.53

(58) Field of Classification Search ..... 29/407.01, 29/407.05, 434, 465, 507, 509, 524.1, 525.05, 29/525.06, 559, 709, 712, 715, 798, 243.53, 29/281.4, 283.5
See application file for complete search history.

(56) References Cited

U.S. PATENT DOCUMENTS 1,004,275 A 12/1911 Kennicott
1,177,738 A 4/1916 Thomson
2,521,505 A 12/1950 Doyle
2,925,748 A 2/1960 Ross
3,292,413 A 12/1966 Falcioni
3,557,442 A 1/1971 Speller
3,747,193 A 7/1973 Gregory (Continued)

FOREIGN PATENT DOCUMENTS

CN 87210763 U 8/1988
CN 2046783 U 11/1989
EP 330341 8/1989
EP 344906 12/1989
JP 2-70348 3/1990

*Primary Examiner*—Jermie E. Cozart
(74) *Attorney, Agent, or Firm*—Chernoff, Vilhauer, McClung & Stenzel, LLP

(57) ABSTRACT

A method and apparatus for forming rivet joints with a desired amount of clearance to allow pivotal motion of the parts interconnected by such joints. Parts to be riveted together are aligned with each other, and a rivet is placed into aligned holes. A parts clamp urges the parts and a preformed head of the rivet against a rivet support anvil to establish an initial condition. A parts support anvil is placed in a required position with respect to the rivet support anvil prior to formation of the second head on the opposite end of the rivet, to provide the desired amount of clearance. The parts support anvil is moved by pushing against a set of arched leaf springs to adjust their effective length, using a hydraulic motor controlled in response to an electrical signal from a transducer that measures movement of parts by the parts support anvil.

12 Claims, 9 Drawing Sheets

U.S. PATENT DOCUMENTS

| | | | |
|---|---|---|---|
| 3,747,194 | A | 7/1973 | Christensen |
| 3,797,365 | A | 3/1974 | Yoshikawa |
| 3,874,070 | A | 4/1975 | Falcioni |
| 3,933,025 | A | 1/1976 | Briles |
| 3,934,330 | A | 1/1976 | Briles |
| 3,971,116 | A | 7/1976 | Goodsmith et al. |
| 4,369,907 | A | 1/1983 | Muhr et al. |
| 4,564,986 | A | 1/1986 | Peterson |
| 4,659,001 | A | 4/1987 | Herten |
| 4,785,529 | A | 11/1988 | Pamer et al. |
| 4,854,491 | A | 8/1989 | Stoewer |
| 4,893,394 | A | 1/1990 | Muller |
| 4,908,928 | A | 3/1990 | Mazurik et al. |
| 5,027,490 | A | 7/1991 | Roberts et al. |
| 5,072,518 | A | 12/1991 | Scott |
| 5,136,873 | A | 8/1992 | Hopkins et al. |
| 5,379,508 | A | 1/1995 | Givler et al. |
| RE35,619 | E | 10/1997 | Muller |
| 5,855,054 | A | 1/1999 | Rivera |
| 6,161,273 | A | 12/2000 | Rivera |
| 6,442,823 | B1 | 9/2002 | Thompson |
| 6,796,020 | B2 | 9/2004 | Thompson |

APPARATUS AND METHOD FOR FORMING RIVET JOINTS

CROSS-REFERENCE TO RELATED APPLICATIONS

This application is a continuation of U.S. patent application Ser. No. 10/922,321, filed Aug. 19, 2004, now U.S. Pat. No. 7,100,272 which is a continuation of U.S. patent application Ser. No. 10/196,584, filed Jul. 15, 2002, now U.S. Pat. No. 6,796,020, which is a division of U.S. patent application Ser. No. 09/631,876 filed Aug. 2, 2000, now U.S. Pat. No. 6,442,823.

BACKGROUND OF THE INVENTION

The present invention is related to riveting and in particular to forming riveted pivot joints including a desired amount of clearance.

It is common in manufacturing to form a joint in which a rivet serves the dual purposes of both fastening two or more parts together and acting as a pivot shaft, as in pliers joints, scissors joints, wire cutters, or various types of pinions. Rivet tension or clearance in such a joint is a factor in determining the amount of friction between two or more pivotally interconnected members. In a joint in a tool such as pliers, it is usually desired to have two or more members in pivotal contact with one another, but not held so tightly together that friction interferes with their use, nor with so much clearance that the parts of a tool feel loose or sloppy with respect to each other. In the case of scissors or wire cutters, looseness may detract from the effectiveness of the tool in its primary cutting function. Such a tool with a loose or sloppy rivet joint is commonly perceived as having low quality.

The most widely used method of controlling the amount of tension or clearance in rivet joints, particularly in tools whose parts pivot with respect to each other, is manual adjustment. That is, after a rivet joint has been formed by machinery, hand tools are used to tighten or loosen the joint as necessary. This often results in inconsistent quality of pivot joints or imperfections in the appearance of a rivet head.

What is needed, therefore, is an improved method and apparatus for automatically forming rivets to form joints having a very small, but accurately established, amount of clearance between the parts riveted together, so that the parts are pivotally movable with respect to one another, with neither excessive friction nor excessive clearance, and without the need for manual adjustment.

SUMMARY OF THE INVENTION

The present invention provides a method and apparatus for mechanically forming a rivet in a riveted pivot joint that interconnects a group of parts and reliably provides a desired amount of clearance despite variations in the total thickness of parts being joined.

In accordance with the method of the present invention, a set of parts to be riveted together is clamped together and supported by a parts clamp that moves the set of parts and a rivet held in an aligned set of rivet holes in the parts to a position in which a preformed first head of the rivet is supported by a rivet support anvil. An initial condition or preliminary position of the parts and the rivet with respect to the rivet support anvil is thereby established. Thereafter, a parts support anvil is adjusted with respect to the rivet support anvil to provide the desired amount of clearance in the riveted joint. The opposite end of the rivet is then upset to form a second head, while the rivet support anvil supports the preformed first head of the rivet independently from the parts support anvil.

The method may include a step of moving the parts support anvil a predetermined distance from initial or preliminary position with respect to the rivet support anvil.

In the method of the present invention, establishing the initial condition or preliminary position of the parts support anvil and rivet support anvil with respect to each other, with the parts and rivet being urged against the rivet support anvil, compensates automatically for the actual dimensions of the rivet and the parts being interconnected, and thus compensates for slight manufacturing variations in the parts, in order to provide a joint having the required amount of clearance. It should be understood that the desired or required amount of clearance may be zero clearance and that during the process of forming a rivet the parts being interconnected may be compressed, where the desired or required clearance is an interference or negative clearance resulting in tension in the rivet when the joint has been completed.

The present invention also provides an apparatus for forming a rivet joint according to the method of the invention, the apparatus including a parts support anvil, a parts clamp, a rivet support anvil capable of supporting a first or preformed head of a rivet located in a set of aligned rivet holes through the parts to be riveted together, and a mechanism associated with the parts support anvil, arranged to move the parts support anvil precisely and to hold it in an adjusted position to cause it to support the parts relative to the rivet support anvil so that when a second rivet head is formed on the opposite end of the rivet the rivet joint will have the desired amount of clearance.

Apparatus which is a preferred embodiment of the invention includes a mechanism to hold the parts clamp and parts support anvil in an initial condition, and a mechanism for adjusting the relationship between the rivet support anvil and the parts support anvil from the initial condition to a condition in which formation of the second head of the rivet provides the required clearance.

In a preferred embodiment of the invention a set of arched leaf springs support the parts support anvil, and its position is adjusted by pressing on the leaf springs to straighten them somewhat and thus elongate them to move the parts support anvil.

In one preferred embodiment of the invention a hydraulic piston and cylinder assembly is used to straighten the leaf springs and to hold them in a required position.

In one preferred embodiment of the invention a sensitive transducer is used to detect and measure movement of the parts support anvil and electrically controlled valves are operated in response to signals produced by the transducer to control movement of the parts support anvil.

The foregoing and other objectives, features, and advantages of the invention will be more readily understood upon consideration of the following detailed description of the invention, taken in conjunction with the accompanying drawings.

BRIEF DESCRIPTION OF THE SEVERAL DRAWINGS

DETAILED DESCRIPTION OF PREFERRED EMBODIMENTS

Figure 1:
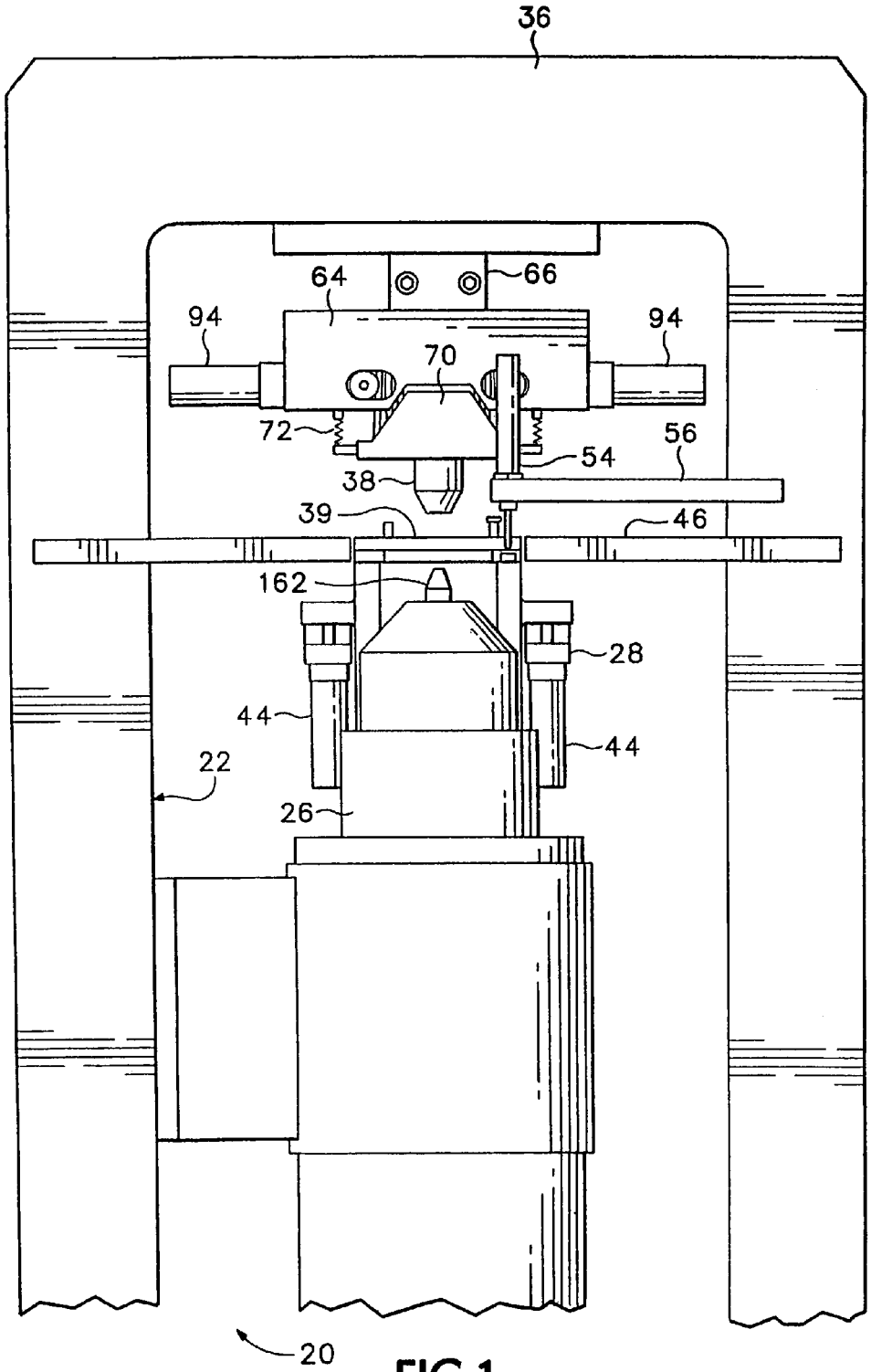
FIG. 1 is a rear elevational view of a riveting machine according to the present invention for use in riveting together a pair of parts to provide a rivet joint having a desired amount of clearance.

Referring now to FIGS. 1-5 of the drawings which form a part of the disclosure herein, a riveting machine 20, shown in simplified form in FIG. 1, includes a suitably strong and rigid supporting structure or frame 22. A pneumatic rivet forming machine 26 is mounted on the supporting structure 22, as is the foundation 28 for a parts clamp 30.

A rivet support anvil 32 includes a working face 33 and a generally cylindrical main body 34 that extends downwardly from a generally horizontal upper member 36 of the supporting structure 22. A parts support anvil 38 is disposed slidably on the generally cylindrical main body 34 of the rivet support anvil 32 and is moveable precisely with respect to the supporting structure 22, and thus with respect to the rivet support anvil 32.

Figure 2:
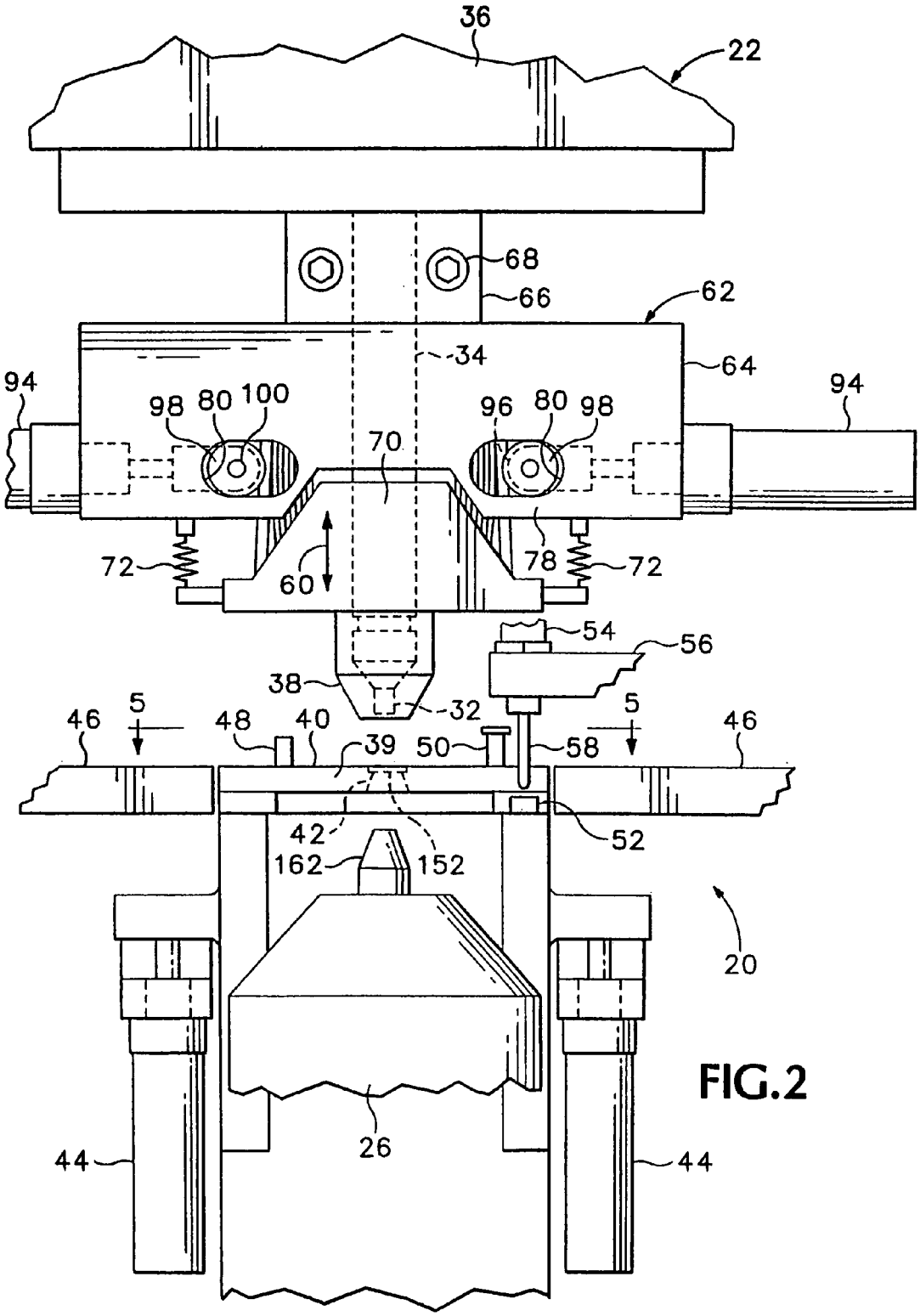
FIG. 2 is a rear elevational view of a portion of the machine shown in FIG. 1, at an enlarged scale.
Figure 3:
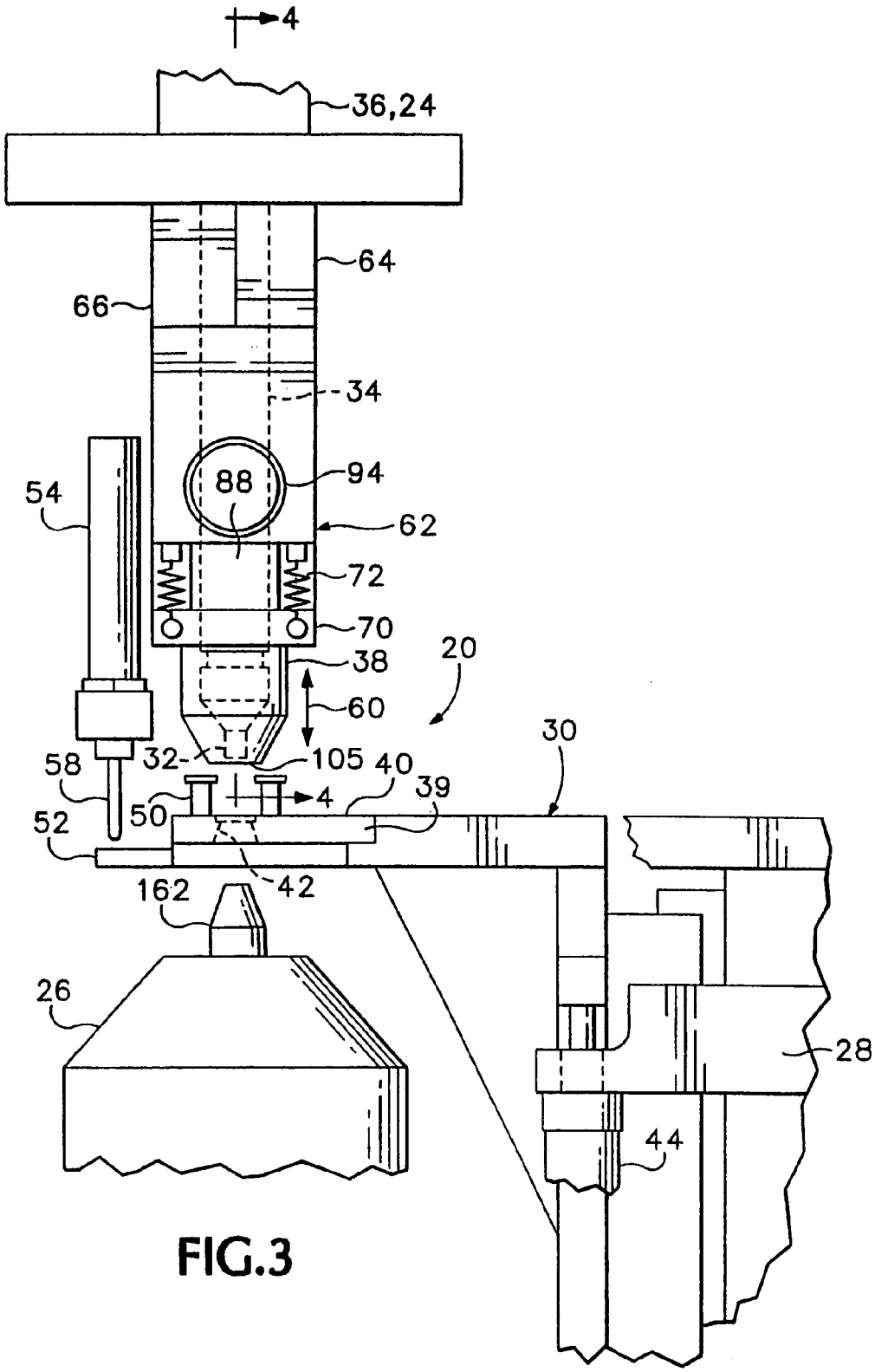
FIG. 3 is an elevational view of the portion of a riveting machine shown in FIG. 2, taken from the right side of FIG. 2.
Figure 5:
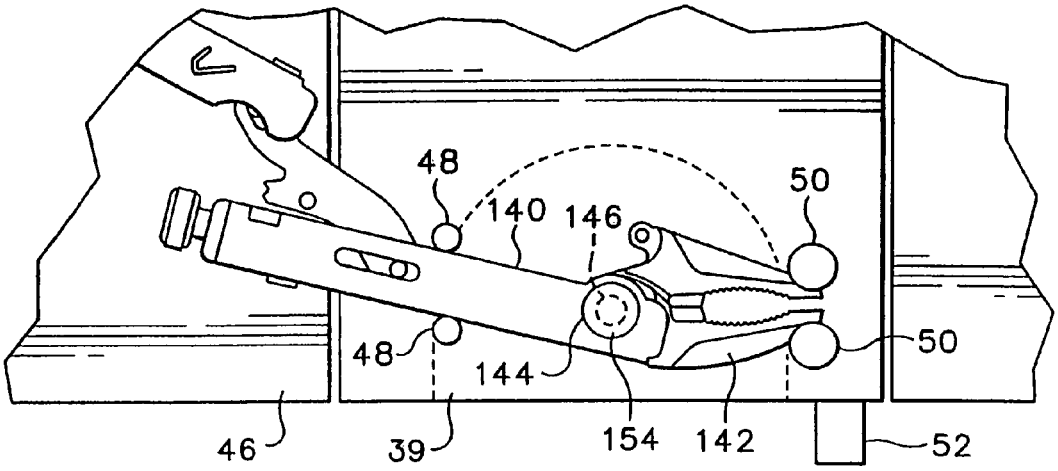
FIG. 5 is a top plan view taken on line 5-5 of FIG. 2, showing a set of parts and a rivet in place a top a parts clamp, in a first step of a method of forming a riveted joint according to the present invention.

The parts clamp 30 includes a parts support jig 39 having a clamping face 40 and defining a riveting opening 42 extending through the clamping face 40. The parts clamp 30 is movable with respect to its foundation 28 and the frame 22 by a motor arrangement, such as pneumatic cylinder-and-piston assemblies 44, of which the cylinders are mounted on the foundation 28, while the pistons are connected to the parts clamp 30 to move it toward or away from the parts support anvil 38. A table 46 surrounds the clamping face 40 and is supported relative to the supporting structure 22 where it is aligned with the clamping face 40 when the parts clamp 30 is in a lowered position as shown in FIGS. 2 and 3. Locator pins 48 and 50 are carried on the support jig 39 to support a set of parts in the proper location, as shown in FIG. 5, during formation of a riveted joint, as will be explained in greater detail subsequently.

A gauge block 52 is carried on the parts clamp 30, and a position sensor 54 is supported on a mounting bracket 56 carried on the supporting structure 22, so that the position sensor 54 is fixed relative to the position of the rivet support anvil. The position sensor 54 includes a spring-loaded plunger 58 whose outer end rests on the gauge block 52 to determine the position of the parts clamp 30 during the process of forming a riveted joint, shown in FIGS. 8-11. One such position sensor 54 of suitable sensitivity and accuracy is an alternating current-operated spring-loaded linear voltage displacement transducer (LVDT) available from the Macro Sensors Division of Howard A. Schaevitz Technologies, Inc. of Pennsauken, N.J., under the designation GHSA 750-250, which has a capability of measuring positions within a range of plus or minus 0.250 inch, with a repeatability of 0.000025 inch, so that it is consistently possible to measure clearance distances extremely precisely.

The parts support anvil 38 is movable in the directions indicated by the arrow 60 in FIGS. 2 and 3, by a parts support anvil adjustment mechanism 62 capable of moving the parts support anvil 38 through small distances precisely measurable by the position sensor 54.

In a preferred embodiment of the invention, as shown in FIGS. 1, 2, 3, and 5, the parts support anvil adjustment mechanism 62 includes a main support body 64 attached to the main body 34 of the rivet support anvil 32 by a clamp body 66 fastened to the main support body 64 by a pair of clamping bolts 68 engaged in corresponding threaded holes in the main support body 64.

A movable parts support anvil carrying body 70 is fitted slidably on the main body 34 of the rivet support anvil 32, whose outer surface guides movement of said anvil carrying body 70. The movable body 70 is urged along the main body 34 of the rivet support anvil 32 toward the main support body 64, and thus away from the parts clamp 30, by a set of coil springs 72 extending in tension between the main support body 64 and the movable body 70.

The main support body 64 defines a pair of similar cavities 76 defined by parallel side walls 78 that are located on opposite sides of the main body of the rivet support anvil 32. Guide apertures 80 are defined by and located correspondingly in each side wall 78 of each cavity 76.

Figure 4:
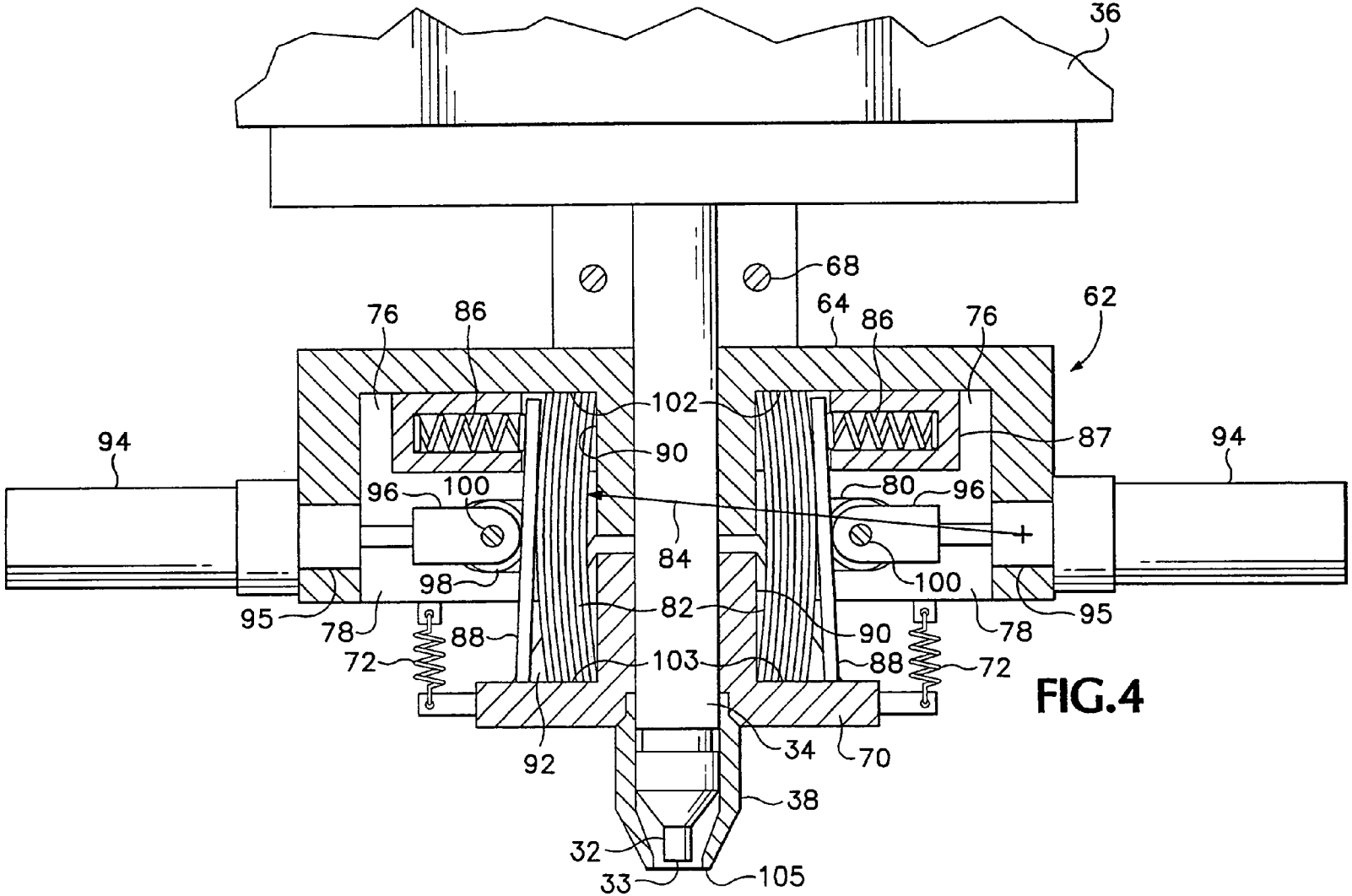
FIG. 4 is a sectional view taken on line 4-4 of FIG. 3 showing the mechanism for adjusting the parts support anvil of the riveting machine shown in FIG. 1.

Within each spring cavity 76, as may be seen best in FIG. 4, are a group of several leaf springs 82, all arched slightly and nested alongside each other. For example, in each spring cavity 76 there may be a set of 35 leaf springs 82, each 0.020 inch thick, and 3.62 inches long, with a radius of curvature 84 of 9.5 inches.

A compression spring 86 is captured in a pocket 87 defined within each spring cavity 76 and presses against a respective backing plate 88, continuously urging the leaf springs 82 of each group toward the inner wall 90 of each of the spring cavities 76, adjacent to the main body 34 of the rivet support anvil 32. The ends of the leaf springs 82 opposite the compression spring 86 are located within pockets 92 aligned generally with the spring cavities 76 and defined within the movable parts support anvil carrying body 70.

A respective hydraulic cylinder-and-piston assembly 94 is mounted in a corresponding opening 95 on each end of the main support body 64. A presser head 96 is mounted on the piston rod of each cylinder-and-piston assembly 94 and presses against the respective backing plate 88. A pair of guide rollers 98 are mounted rotatably on a roller shaft 100 extending through each presser head 96. The guide rollers 98 are disposed within the respective guide apertures 80 and support the piston rods of the hydraulic cylinder-and-piston assemblies 94, keeping them aligned with the cylinders. As the piston rod of each cylinder-and-piston assembly 94 extends from the cylinder the presser head 96 pushes the respective backing plate 88 against the set of leaf springs 82, tending to straighten the leaf springs 82. As the leaf springs 82 are straightened they are also elongated, and thus force the movable body 70 away from the main support body 64. Using several springs thus arranged provides required column strength along the length of the springs to support the parts support anvil 38 yet allows the set of leaf springs to be partially straightened using a reasonably small force from the cylinder-and-piston assemblies 94.

The opposite ends of the leaf springs 82 bear upon the opposing, parallel interior surfaces 102 and 103 of the main support body 64 and the movable body 70, so that straightening the leaf springs 82 moves the movable body 70 away from the upper member 36 of the supporting structure 22, along the main body 34 of the rivet support anvil 32, overcoming the tension in the coil springs 72. As the movable body 70 is moved by straightening the leaf springs 82, the face, or supporting surface 105 of the parts support anvil 38 is moved toward the parts clamp 30 with respect to the supporting structure 22 and thus with respect to the rivet support anvil 32. Conversely, when the leaf springs 82 are allowed to elastically resume a more curved configuration the parts support anvil 38 is retracted by the coil springs 72.

It will be understood that other types of motors could also be used instead of the hydraulic cylinder-and-piston assemblies 94, although perhaps not to the same degree of precision. For example, screws driven by electric stepping motors (not shown) might also be utilized to move the backing plates 88 against the respective sets of leaf springs 82 to control the position of the parts support anvil 38.

Figure 6:
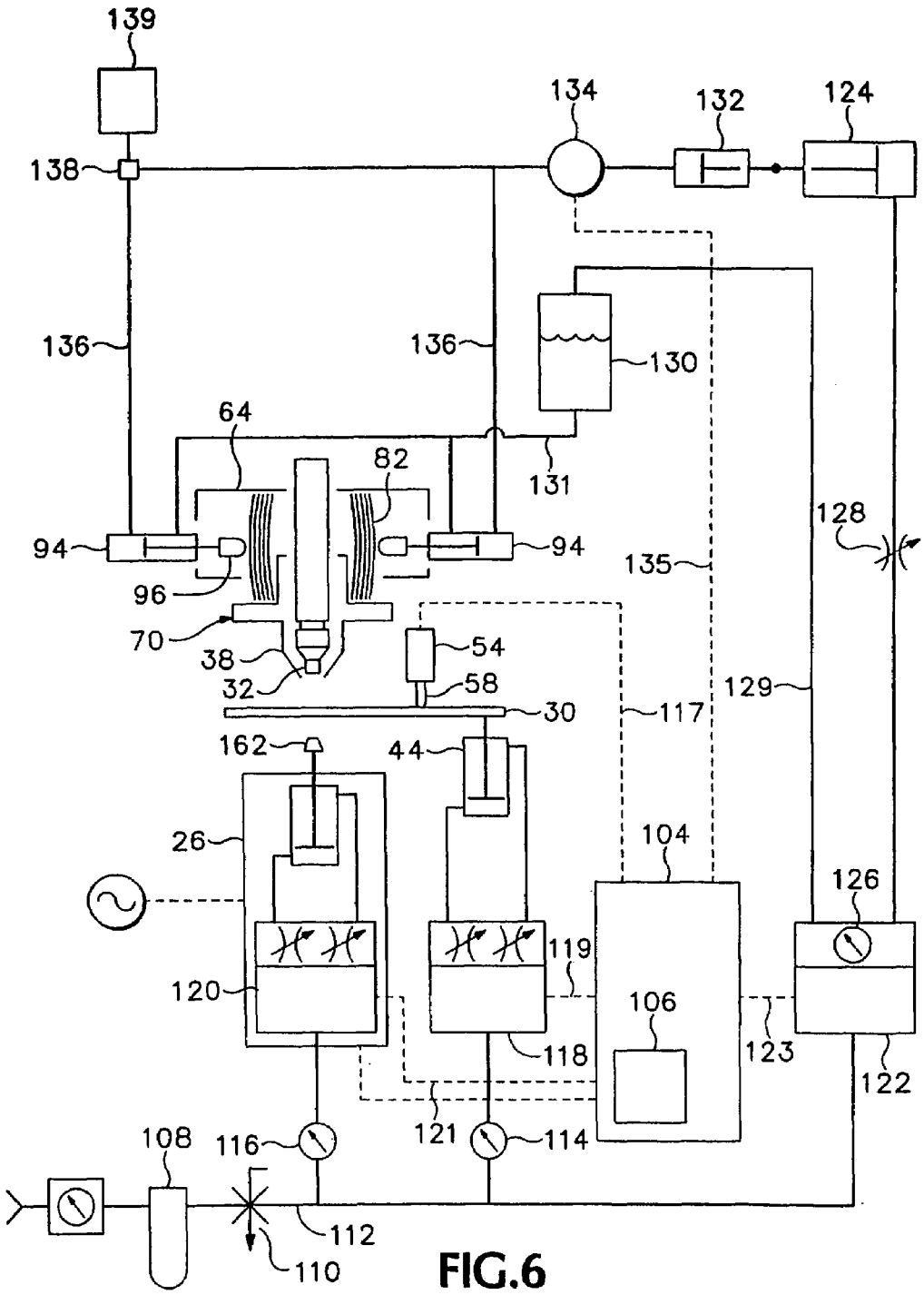
FIG. 6 is a simplified schematic diagram of the power and control system for the riveting machine shown in FIGS. 1-5.
Figure 8:
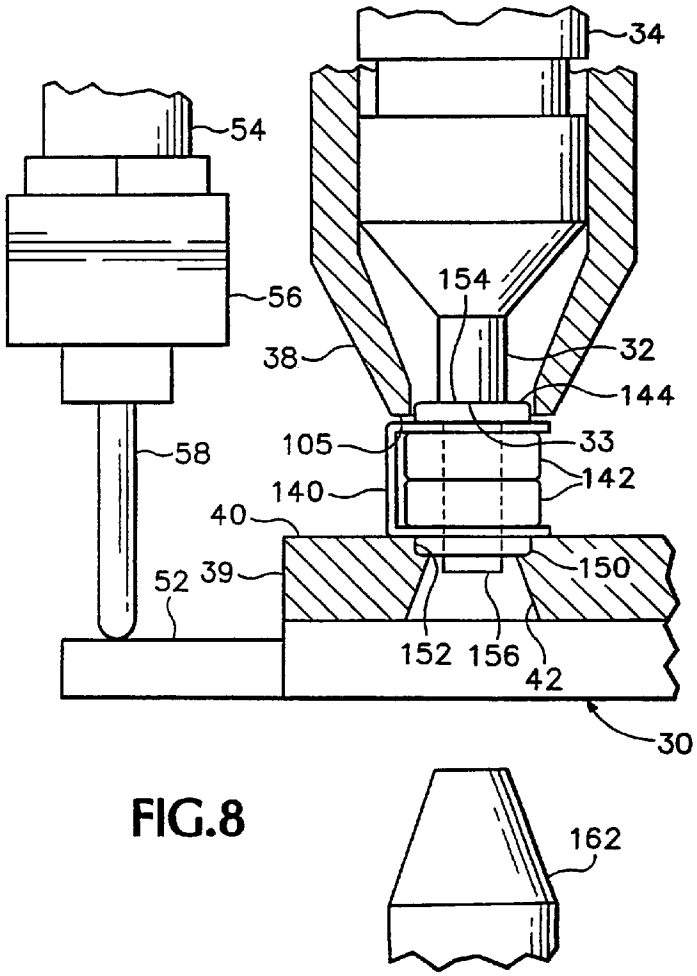
FIG. 8 is a view similar to FIG. 7, showing a further step of forming a riveted joint according to the present invention.
Figure 7:
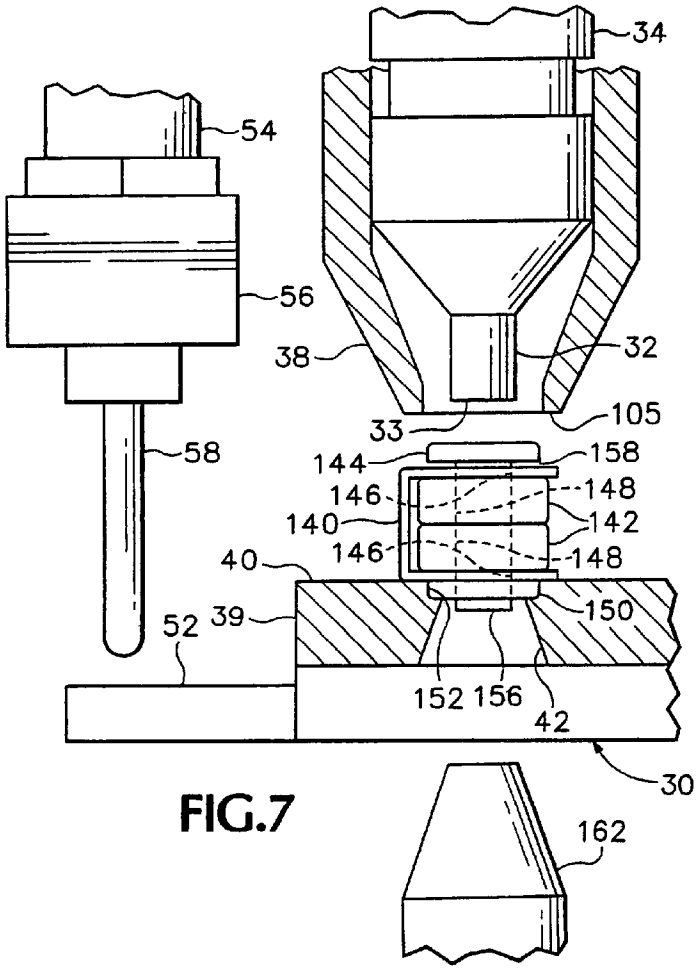
FIG. 7 is a sectional view taken in the direction of FIG. 3, showing the rivet support anvil, parts support anvil, parts clamp, and rivet forming head at an enlarged scale at a first step of forming a riveted joint in accordance with the invention.

In order to control the operation of the mechanism shown in FIGS. 1-5, a control system shown in simplified form in FIG. 6 includes a programmable main controller 104 connected to an appropriate electrical power supply and including a timer 106.

A supply of air under pressure, such as a 100 psi air supply, is provided through an appropriate filter 108 and a main cutoff valve 110 to a main supply conduit 112. A precision pressure regulator 114 provides air from the conduit 112 to a solenoid valve 118, connected to the controller 104 by an electrical conductor 119, to control the cylinder-and-piston assemblies 44 that move the parts clamp 30. An electrical conductor set 117 of one or more conductors, as required, interconnects the position sensor 54 with the controller 104.

A pressure regulator 116 provides a supply of air under pressure to a solenoid valve 120, connected to the controller 104 by an electrical conductor 121, to control the supply of air to the rivet forming machine 26 to extend and retract its forming head and to cause it to form a second head on a rivet.

The main air supply conduit 112 is also connected to a solenoid valve 122 that, in a first condition, provides air under pressure to a pneumatic cylinder-and-piston assembly 124, through a pressure regulating valve 126 and a flow regulating valve 128. An electrical conductor 123 interconnects the solenoid valve 122 with the controller 104. When the solenoid valve 122 is in a second condition the pressure regulating valve 126 instead provides air at a similarly regulated pressure through a conduit 129 to an accumulator 130, thus providing pressure to urge hydraulic fluid through a conduit 131 to the piston rod end of each of the hydraulic cylinder-and-piston assemblies 94, to retract the piston rods and presser heads 96 away from the backing plates 88.

The piston rod of the cylinder-and-piston assembly 124 is connected directly to the piston rod of a hydraulic cylinder-and-piston assembly 132, so that extension of the piston rod from the cylinder-and-piston assembly 124 drives the piston of the cylinder-and-piston assembly 132 into the cylinder. This expels hydraulic fluid from the cylinder through an electrically controlled hydraulic valve 134, connected to the controller 104 electrically by a conductor 135, and thence through a hydraulic fluid conduit 136 to each of the hydraulic cylinder-and-piston assemblies 94. The piston rods then extend from the cylinders and partially straighten the sets of leaf springs 82 and thus move the parts support anvil 38 towards the parts clamp 30.

The hydraulic conduit 136 includes a bleed valve 138 arranged to eliminate any gas from within the hydraulic cylinder-and-piston assemblies 94 and the conduit 136. Connected to the conduit 136 in conjunction with the bleed valve 138 is a fluid reservoir 139. When the electrically controlled valve or solenoid 134 is closed the piston rods of the cylinder-and-piston assemblies 94 will remain properly extended and substantially immovable, supported by the substantially incompressible liquid hydraulic fluid contained in the cylinders and in the conduits 136.

The pneumatic cylinder-and-piston assembly 124 is of a larger diameter, and thus has a larger displacement for the same distance of piston travel than does the hydraulic cylinder-and-piston assembly 132. Thus, when the solenoid valve 122 provides air under pressure through the flow regulating valve 128 to the cylinder-and-piston assembly 124 the resultant movement of the interconnected piston rods of the cylinder-and-piston assemblies 124 and 132 delivers hydraulic fluid to the cylinder-and-piston assemblies 94 at a pressure sufficient to overcome the back pressure provided from the accumulator 130 and to move the pistons with ample force to move the parts support anvil 38 as required, and at a rate regulated by the flow control valve 128. The bore of the cylinder-and-piston assemblies 94 is large enough to provide sufficient force to overcome the elastic restorative forces of the springs 82 and 72 and forces from the parts clamp 30 acting through parts being joined and through the leaf springs 82, and to withstand a component of the forces resulting from forming a second rivet head.

The main controller 104 may be, for example, a commercially available programmable controller having the ability to establish a timing sequence and to receive and respond to electrical signals from a transducer such as the sensor 54, and to provide control signals to operate several external devices such as the solenoid valves 118, 120, 122, and 134, and a device such as the rivet forming machine 26. Such a main controller 104 should also be capable of receiving individual control signals from operational control switches (not shown) to accomplish manual, rather than automatic, control of the riveting machine 20. One such device which has proved satisfactory for controlling such a riveting machine is available from the Mitsubishi Corporation as its Series FX 2N programmable controller.

Referring now to FIGS. 5 and 7-11, a set of parts such as a channel-shaped handle 140 and a pair of jaws 142 are to be riveted together. The parts are placed together properly aligned with one another, and a rivet 144 is inserted through a corresponding set of aligned bores 146, 148 of the correct diameter. For assembly of the tool shown in FIG. 5, a rivet collar 150 is placed within a corresponding cavity 152 defined in the support jig 39 in line with the riveting opening 42, although it will be understood that such a collar is not needed in many rivet joints. The set of parts, that is, the handle 140 and jaws 142, are placed together with the rivet 144 on the parts support jig 39, with the preformed head 154 of the rivet 144 upward, and the opposite end 156 of the rivet 144 extending through the collar 150. The locator pins 48 and 50 keep the set of parts of the tool in the proper location with respect to the support jig 39.

Although not shown as such herein, the support jig 39 may be movable together with a portion of the table 46 so that the set of parts may be placed upon the support jig 39 at a position spaced apart from the location of the rivet support anvil and parts clamp. Once the set of parts and the rivet 144 are properly positioned in the support jig 39, the support jig 39 is moved, if necessary, into the position shown in FIG. 7 with respect to the rivet support anvil 32.

The appropriate signal is then provided by the controller 104 to the solenoid valve 118 to extend the cylinder-and-piston assembly 44 to raise the parts clamp 30, and thus to raise the set of parts and the rivet 144 toward the working face 33 of the rivet support anvil 32. As the parts clamp 30 is raised, the gauge block 52 is brought into contact with the end of the plunger 58 of the position sensor 54, which then provides an electrical signal on the conductor set 117 indicating a change of position to the controller 104. When the preformed head 154 of the rivet 144 encounters the support face of the rivet support anvil 32 any clearance in the set of parts, or between the upper surface of the handle 140 and the preformed head 154 of the rivet 144, will be eliminated to the extent possible by the force of the pneumatic cylinder-and-piston assemblies 44 of the parts clamp 30, and the support surface 40 of the parts clamp 30 will then stop moving toward the rivet support anvil.

The air pressure provided to the cylinder-and-piston assemblies 44 by the pressure regulator 114 is preferably controlled to limit the force exerted by the parts clamp 30 to be small enough not to deform parts to be fastened together. The rate of flow of the air to the cylinder-and-piston assemblies 44 is also controlled to limit the speed of movement of the parts clamp 30. Other motors also arranged to move at controlled speeds and to exert controlled force, might also be used instead. These might include hydraulic cylinder-and-piston assemblies or ball screw arrangements driven by electric or pneumatic motors with appropriate controls, provided that the arrangement includes a way for the parts clamp 30 to be moved resiliently by the parts support anvil 38 acting through a set of parts to be riveted.

When the controller 104 detects no further change in the signal from the position sensor 54 for a certain amount of time, indicating that the parts clamp 30 has moved as far as possible toward the rivet support anvil 32, the controller 104 sends an electrical signal to operate the solenoid valve 122 to direct air into the cylinder-and-piston assembly 124. At this point in the operation of the riveting machine 20 the solenoid-operated hydraulic valve 134 is open, and a flow of hydraulic fluid is forced from the cylinder-and-piston assembly 132 along the hydraulic conduit 136, causing the hydraulic cylinder-and-piston assemblies 94 to extend their piston rods, straightening the leaf springs 82 and thus moving the parts support anvil 38 toward the handle 140.

The parts support anvil 38 is designed to fit around the preformed head 154 of the rivet 144 and to press upon the upper surface of the handle 140 without bearing upon the preformed head 154. When the working face 105 of the parts support anvil 38 encounters the top surface of the handle 140 it exerts sufficient force to move the set of parts, and thus the parts clamp 30, overcoming the force provided by the cylinder-and-piston assemblies 44. The slightest movement of the parts clamp 30 causes the gauge block 52 also to move, and its motion to be detected by the position sensor 54. The signal sent via the conductor set 117 indicating an initial change of position will be interpreted by the controller 104 as establishing an initial position of the parts support anvil 38 from which it needs to be moved a required distance to result in the desired clearance of the completed riveted joint. The required distance to move the parts support anvil 38 is initially determined empirically and is used thereafter in programming the controller 104 for riveting a particular type of assembly, using fairly uniform parts and rivets of known composition. Once the correct amount of adjustment has been determined, the same adjustment of the position of the parts support anvil 38 from the initial condition established as described above will result in the desired amount of clearance in each similar joint made thereafter.

When the desired amount of movement of the parts support anvil 38 with respect to the rivet head support anvil has taken place, as measured by movement of the gauge block 52 detected by the position sensor 54, the controller 104 will close the solenoid-operated hydraulic valve 134, thus hydraulically blocking further movement of the parts support anvil 38 with respect to the supporting structure 22, and thus with respect to the rivet head support anvil. The position of the parts support anvil 38 can thus be adjusted and held precisely and reliably at positions controlled to within less than 0.0001 inch.

Figure 9:
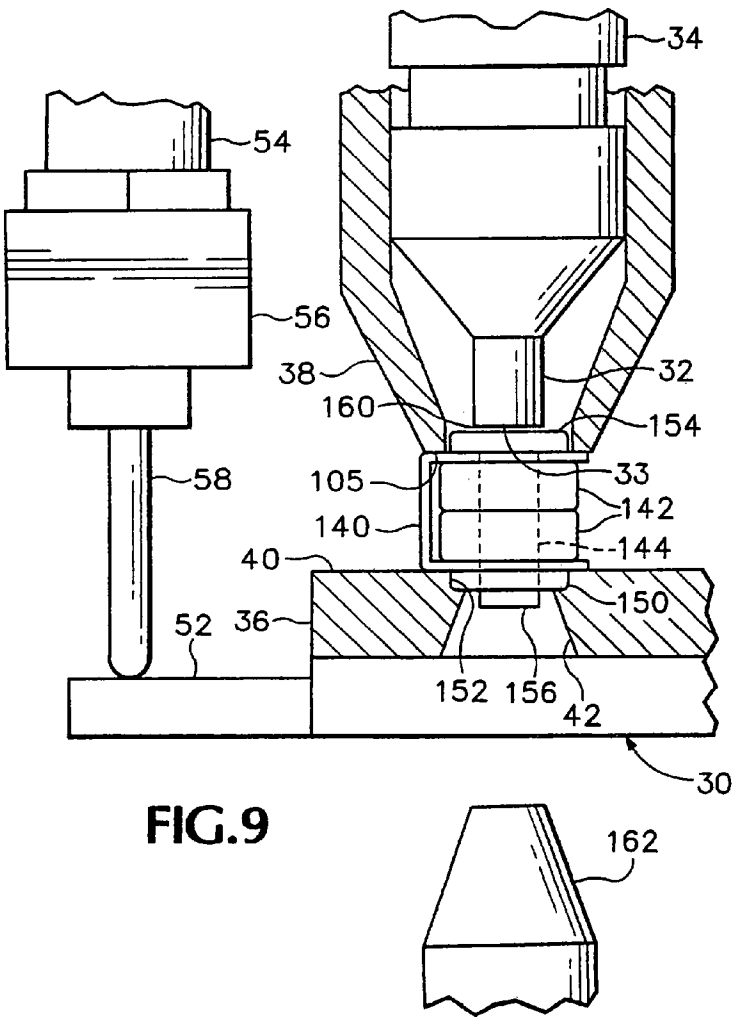
FIG. 9 is another view similar to FIG. 7 at yet a further step according to the present invention.

As shown in FIG. 9, the parts support anvil 38 has moved downward, forcing the handle 140 and jaws 142 down with respect to the rivet support anvil, until the required movement is provided. As shown, then, there is a gap or clearance 158 between the preformed head 154 of the rivet 144 and the upper surface of the handle 140, and a gap or clearance 160 between the rivet support anvil 32 and the preformed head 154. While the clearances 158, 160 shown in FIG. 9 are greatly exaggerated, it will be appreciated that proper movement of the parts support anvil 38 with respect to the rivet head support anvil 32 will produce the required clearance.

Figure 10:
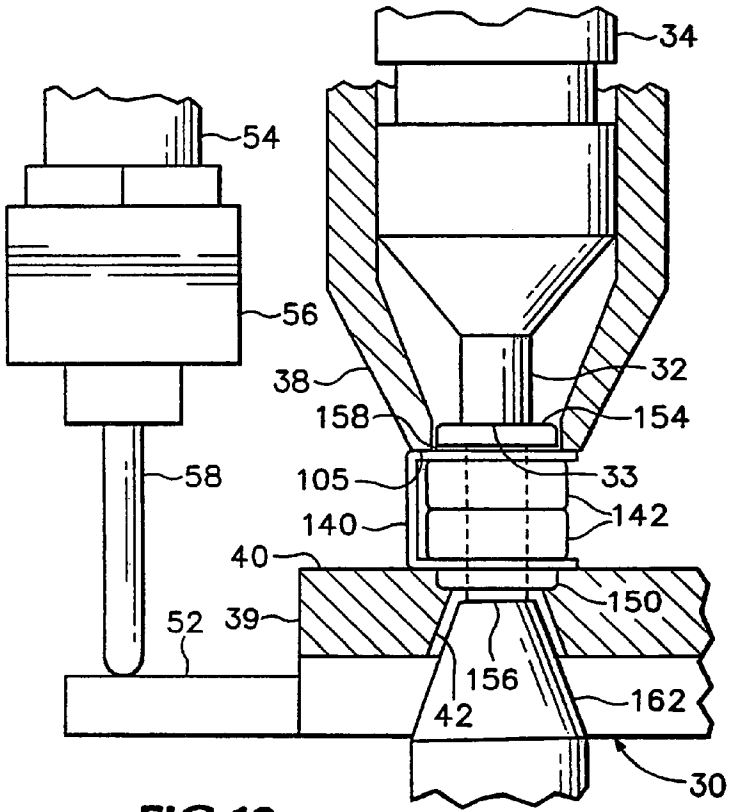
FIG. 10 is another view similar to FIG. 7, showing a further step of forming a rivet joint using the apparatus of the invention, with the rivet forming head in contact with a second end of the rivet.
Figure 11:
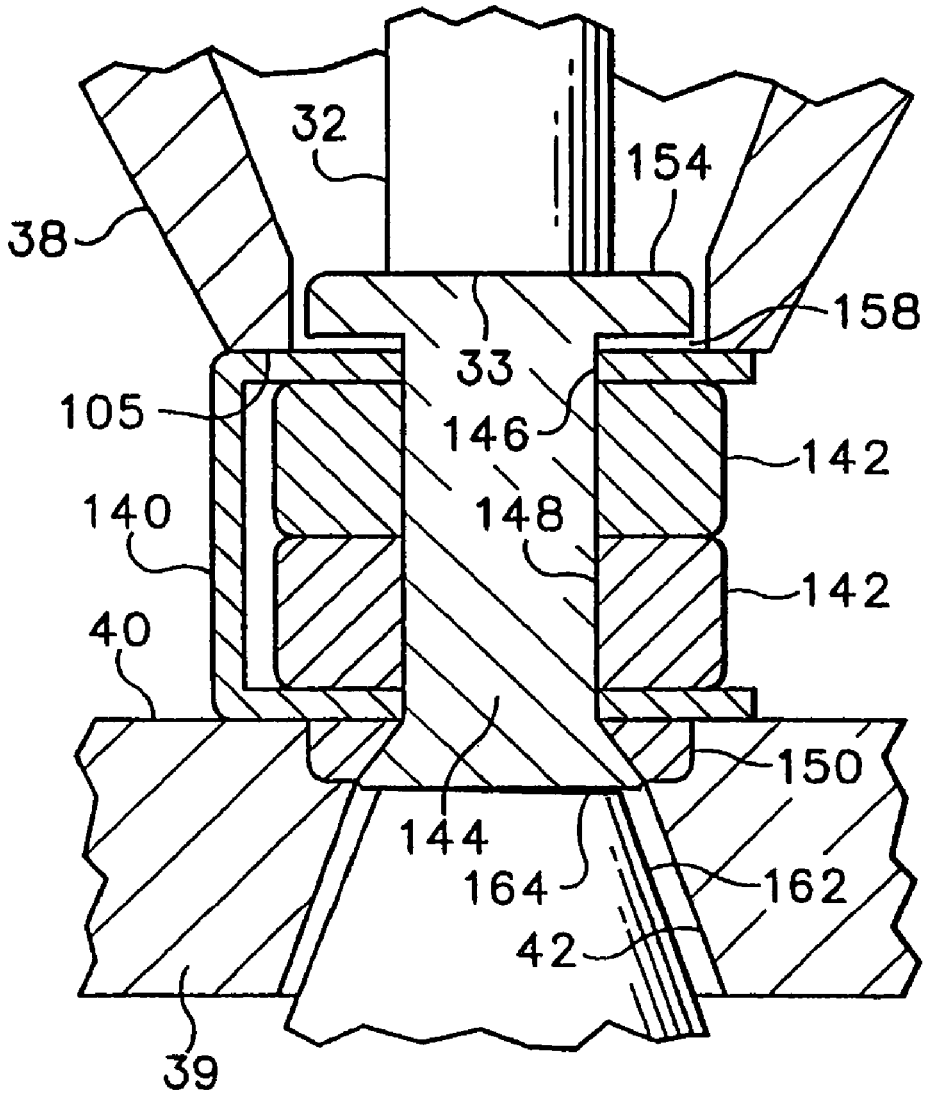
FIG. 11 is yet a further view similar to FIG. 7, showing completion of a second head on the rivet.

With these relative positions of the rivet support anvil 32 and the parts support anvil 38 thus maintained, the controller 104 then sends an electrical signal to the solenoid valve 120 causing the forming head 162 of the rivet forming machine 26 to be raised into engagement with the shank end 156 of the rivet 144, as shown in FIG. 10. The rivet forming machine 26 is then operated at a preset pressure and for a predetermined amount of time, as regulated by the timer 106, to form the second head 164 on the rivet 144. The pressure applied by the riveter head 162 upsets the end 156 of the rivet, causing a portion of the body of the rivet 144 to expand radially within the collar 150 and forming the second head 164 on the rivet 144, as shown in FIG. 11. The particular type of forming machine used is not critical so long as it can supply the required force, and the rivet forming machine 26 may be a pneumatic or hydraulic orbital or radial riveter, for example.

One satisfactory rivet forming device 26 suitable for forming steel rivets is an electrically and pneumatically driven radial former equipped with a carbide-tipped forming tool or head 162. Such a machine is available from the Bracker Corporation of Canonsburg, Pa., as its RNE 331 machine, which has the capacity to provide 7,800 pounds of force through a forming stroke whose length is in the range from 5-50 millimeters, and which also has an initial engagement stroke length of up to 50 millimeters.

The forces exerted in urging the parts clamp 30 against the parts to be assembled and against the parts support anvil 38 and the rivet support anvil 32 in establishing the initial position are reasonably uniform, as may be assured by regulating the pressure utilized in the cylinder-and-piston assemblies 44. So long as the force exerted on the rivet 144 by the riveting head 162 is not so great that it overcomes or causes significantly different amounts of flexure in the supporting structure 22 supporting the rivet support anvil 32 and the parts support anvil 38 or so great that it deforms the parts to be connected by the rivet 144, the amount of pressure exerted by the riveting machine 26 and the dwell time during which the pressure is exerted do not affect the eventual clearance distance which can be obtained.

As shown in FIG. 11, the second head 164 is formed on the rivet 144 by the riveting head 162 while an amount of clearance 158 is preserved between the preformed head 154, supported by the rivet support anvil 32, and the handle 140 supported by the parts support anvil 38 against the pressure of the rivet forming machine 26. Thereafter, the tool may be removed from the riveting machine 20, and the second head 164 may be ground or machined, if desired, for the sake of appearance.

The adjustment of the parts support anvil 38 with respect to the rivet support anvil 32 may not result in actual movement of the parts support anvil 38 with respect to the rivet support anvil 32 when the adjustment is made, because of any elasticity of the frame 22 and the fastenings of the rivet support anvil 32 to the frame 22. It would be expected that if the frame 22 and the connections of the rivet support anvil 32 to the frame 22 were completely rigid there would have to be an adjustment moving the parts support anvil 38 away from the head 154 of the rivet 144. In fact, because of flexibility of the parts to be connected, or of the frame 22, or other such factors, the required adjustment of the parts support anvil 38 might in some cases be in the direction allowing additional preloading of the frame 22 to support the rivet head 154 more firmly, if the riveting head 162 is able to move the rivet support anvil 32 with respect to the parts support anvil 38, or to compress the set of parts to be connected when it urges the rivet head 154 against the rivet head support anvil face 33 in the process of forming the second head 164. While the clearance distance 158 is shown in the drawings as an actual space between the head 154 and a surface of the tool handle 140, the desired or required clearance in some cases may be zero, or may be an interference allowing some compression of parts during formation of the second head 164 of the rivet, in order to result in a desired amount of tension in the rivet when formation of the joint has been completed.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for forming a riveted joint interconnecting a plurality of parts, comprising:

a. a supporting structure;

b. a rivet support anvil mounted fixedly on said supporting structure;

c. a parts support anvil located adjacent said rivet support anvil;

d. a parts clamp member facing toward said parts support anvil and movable toward and away from said rivet support anvil;

e. means for moving said parts clamp member, together with a plurality of parts to be riveted and a rivet extending through aligned holes defined in said plurality of parts, to an initial condition relative to said rivet support anvil wherein a first end of said rivet is supported by said rivet support anvil;

f. means for moving said parts support anvil thereafter to an initial condition position with respect to said rivet support anvil;

g. a parts support anvil adjustment mechanism arranged between said supporting structure and said parts support anvil to move said parts thereafter with respect to said rivet support anvil to place said parts into an adjusted condition; and h. rivet head forming means for forming a head at a second end of said rivet while said parts remain in said adjusted condition.

2. The apparatus of claim 1 wherein said supporting structure is a frame.

3. The apparatus of claim 2 wherein said means for moving said parts clamp member includes a plurality of screws driven by electric stepping motors.

4. The apparatus of claim 2 wherein said means for moving said parts clamp member includes a ball screw arrangement driven by electric motors.

5. The apparatus of claim 2 wherein said means for moving said parts clamp member includes a ball screw arrangement driven by pneumatic motors.

6. The apparatus of claim 1 wherein said means for moving said parts clamp member includes a motor arranged to move at controlled speed and to exert controlled force.

7. The apparatus of claim 1 wherein said rivet head forming means includes a pneumatic orbital riveter.

8. The apparatus of claim 1 wherein said rivet head forming means includes a hydraulic orbital riveter.

9. The apparatus of claim 1 wherein said rivet head forming means includes a pneumatic radial riveter.

10. The apparatus of claim 1 wherein said rivet head forming means includes a hydraulic radial riveter.

11. The apparatus of claim 1 wherein said rivet head forming means is an electrically and pneumatically driven radial former equipped with a carbide-tipped forming tool.

12. A method of riveting a plurality of parts together to form an assembly with a predetermined clearance or interference between a rivet and said plurality of parts interconnected by said rivet, comprising:

(a) providing a rivet support anvil mounted fixedly on a supporting structure;

(b) providing a parts clamp supported movably on said supporting structure;

(c) inserting a rivet including a preformed first head into a rivet hole so that said rivet extends through said plurality of parts to be riveted together, leaving said preformed first head on a first side of said plurality of parts to be riveted together;

(d) urging said parts clamp against a second side of said plurality of parts to be riveted together, thereby urging said preformed first head against a rivet support anvil and urging said rivet into said rivet hole and into contact with said first side of said plurality of parts, to establish a reference position of said parts clamp;

(e) thereafter urging a parts support anvil into engagement with said first side of said plurality of parts, thereby establishing an initial position of said parts support anvil with respect to said rivet support anvil;

(f) thereafter moving said parts support anvil a predetermined distance, thereby placing said parts support anvil in a predetermined adjusted position with respect to said initial position; and (g) thereafter forming a second head on said rivet while retaining said parts support anvil in said predetermined adjusted position with respect to said rivet support anvil.

* * * * *